United States Patent [19]

Mastroni, Jr.

[11] Patent Number: 5,007,321

[45] Date of Patent: Apr. 16, 1991

[54] POWER OPERATED STRING VIBRATING DEVICE FOR SELECTIVELY VIBRATING A STRING OF A STRINGED MUSICAL INSTRUMENT

[76] Inventor: Frederick J. Mastroni, Jr., 89 Gregory Pl., Richboro, Pa. 18954

[21] Appl. No.: 352,785

[22] Filed: May 16, 1989

[51] Int. Cl.[5] ..... G10D 3/16

[52] U.S. Cl. ..... 84/325

[58] Field of Search ..... 84/10–11, 84/256–257, 325–326

[56] References Cited

U.S. PATENT DOCUMENTS

| | | | |
|---|---|---|---|
| 247,924 | 10/1881 | Kemper | 84/257 |
| 536,886 | 4/1895 | Muller | 84/325 |
| 678,318 | 7/1901 | Marshall | 84/10 |
| 900,021 | 9/1908 | Klink | 84/326 |
| 1,300,894 | 4/1919 | Strawn | 84/326 |
| 1,667,925 | 5/1928 | Brody | 84/325 |
| 4,037,503 | 7/1977 | Jacobson et al. | 84/9 |

FOREIGN PATENT DOCUMENTS

| | | | |
|---|---|---|---|
| 154613 | 9/1904 | Fed. Rep. of Germany | 84/325 |
| 291530 | 4/1916 | Fed. Rep. of Germany | 84/257 |
| 587167 | 4/1925 | France | 84/326 |

*Primary Examiner*—Lawrence R. Franklin

*Attorney, Agent, or Firm*—Panitch Schwartz Jacobs and Nadel

[57] ABSTRACT

A power operated string vibrating device for selectively vibrating a string of a stringed musical instrument having at least one string. The string vibrating device comprises a support member positioned on the musical instrument proximate a string. A first pulley is rotatably mounted on the support member on a first side of a string for receiving a cable. The first pulley has one of the strings associated therewith. A second pulley is rotatably mounted on the support member on a second side of the string for receiving the cable. The second pulley is movable between a first position and a second position. A spring biases the second pulley towards the first position. An endless cable is drivingly interconnected to the pulleys such that when the second pulley is in the first position the cable does not contact the string, and when the second pulley is in the second position the cable contacts the string. An electric motor is mounted on the support member for driving the cable at a predetermined speed. A finger engageable button is mounted on the support member for selectively moving the second pulley to the second position, whereby when the second pulley is in the first position, the string does not produce sound and when the second pulley is in the second position, the string is vibrated by the cable and thereby produces sound.

9 Claims, 2 Drawing Sheets

FIG. 7
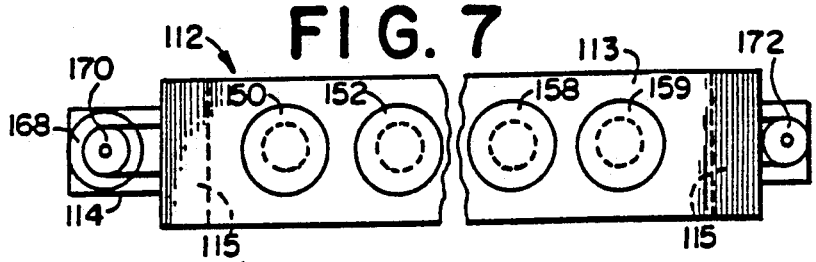
FIG. 2
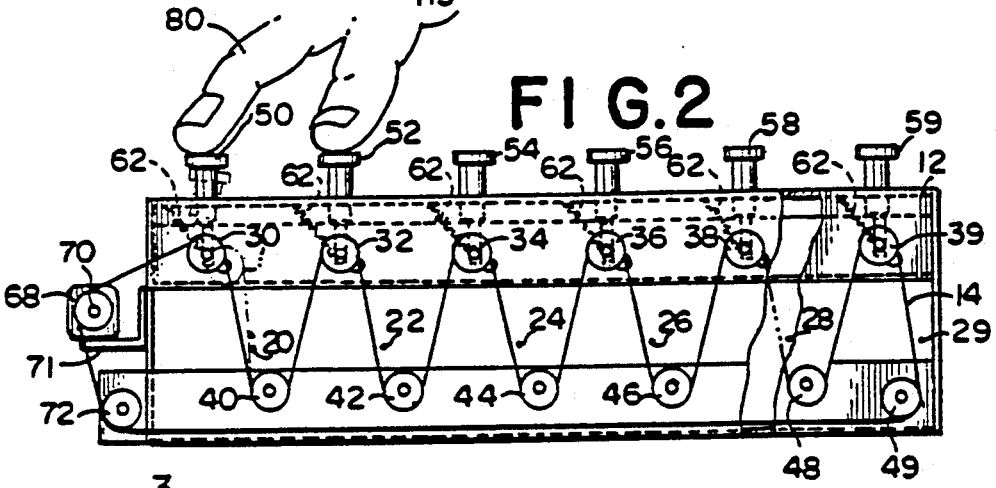
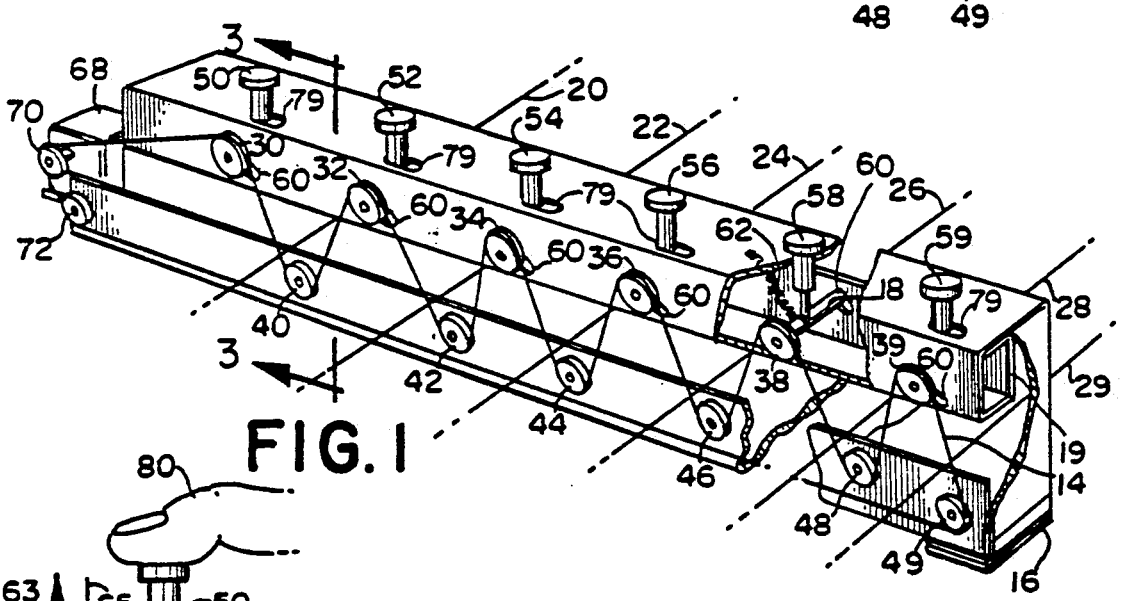
FIG. 1
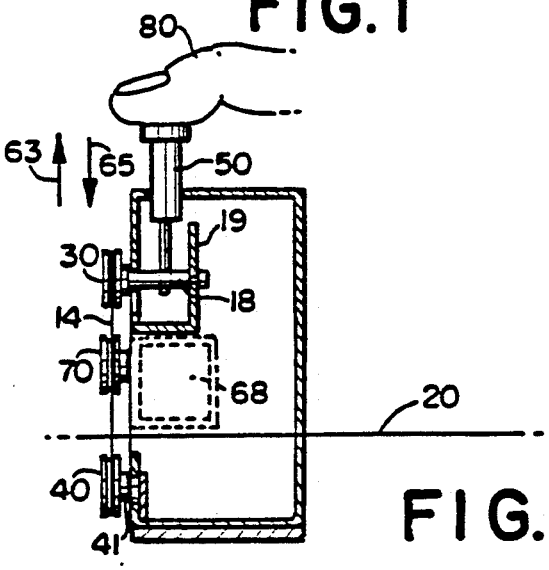
FIG. 3

POWER OPERATED STRING VIBRATING DEVICE FOR SELECTIVELY VIBRATING A STRING OF A STRINGED MUSICAL INSTRUMENT

FIELD OF THE INVENTION

The present invention relates to musical stringed instruments and, more particularly, to a power operated string vibrating device for selectively vibrating a string of a stringed musical instrument.

BACKGROUND OF THE INVENTION

The present day musical, stringed instrument, such as a guitar, includes a hollow body having a neck extending therefrom, with laterally spaced tensioned strings being supported in longitudinally extending positions thereon and in pressure contact with a tail piece. Guitars have fretted necks to serve as a fingerboard. Vibrations of the strings are transmitted from the tail piece to the top of the body. The top is coupled to the bottom of the body by a post. The top has an opening therein. The top and bottom, the opening, and the hollow interior of the body form a multi-resonant system for coupling the vibrating strings to the air to produce musical tones.

In an electric guitar, the vibrations of the strings are transmitted to a bridge, which bridge, in turn, transmits the vibrations to a mechano-electric transducer. The transducer converts the mechanical vibrations into corresponding electrical vibrations. These vibrations are amplified by suitable electrical means to energize a loudspeaker to produce musical tones.

In both the conventional guitar and the electrical version thereof, the strings are plucked by the fingers or with a pick to cause the strings to vibrate. However, the vibrations of the plucked strings quickly dampen out and the musical tones produced thereby is of short duration.

The present invention overcomes the above-described disadvantages by providing a manually actuated, power operated device that permits at least one moving member to be brought selectively into light pressure contact with a string of the musical stringed instrument to cause the former to vibrate. The string will vibrate so long as such pressure contact is effected, and, as a result, novel and unusual musical effects may be achieved from the stringed instrument, such as a conventional or electric guitar, that are not attainable when the strings are merely plucked.

SUMMARY OF THE INVENTION

Briefly stated, the present invention comprises a power operated string vibrating device for selectively vibrating a string of a stringed musical instrument having at least one string. The string vibrating device comprises a support member positioned on the musical instrument proximate the string. A first pulley is rotatably mounted on the support member on a first side of the string for receiving a cable. The first pulley has one of the strings associated therewith. A second pulley is rotatably mounted on the support member on a second side of the string for receiving the cable. The second pulley is movable between a first position and a second position. Biasing means biases the second pulley towards the first position. An endless cable drivingly interconnects the pulleys such that when the second pulley is in the first position, the cable does not contact the string, and when the second pulley is in the second position, the cable contacts the string. The device further includes drive means on the support member for driving the cable at a predetermined speed. Also mounted on the support member is an actuator means for selectively moving the second pulley between the first and second positions, whereby when the second pulley is in the first position, the string does not produce sound, and when the second pulley is in the second position, the string is vibrated by the cable and thereby produces sound.

BRIEF DESCRIPTION OF THE DRAWINGS

The foregoing summary, as well as the following detailed description of preferred embodiments, will be better understood when read in conjunction with the appended drawings. For the purpose of illustrating the invention, there is shown in the drawings embodiments which are presently preferred, it being understood, however, that the invention is not limited to the specific methods and instrumentalities disclosed. In the drawings:

FIG. 1 is a perspective view in partial cross section of a power operated string vibrating device in accordance with a first preferred embodiment of the present invention;

FIG. 2 is an enlarged front elevational view of the power operated string vibrating device of FIG. 1;

FIG. 3 is an enlarged sectional view of the power operated string vibrating device of FIG. 1 taken along line 3—3 of FIG. 1;

FIG. 7 is a top plan view of the power operated string vibrating device of FIG. 6.

DESCRIPTION OF THE PREFERRED EMBODIMENTS

Figure 4:
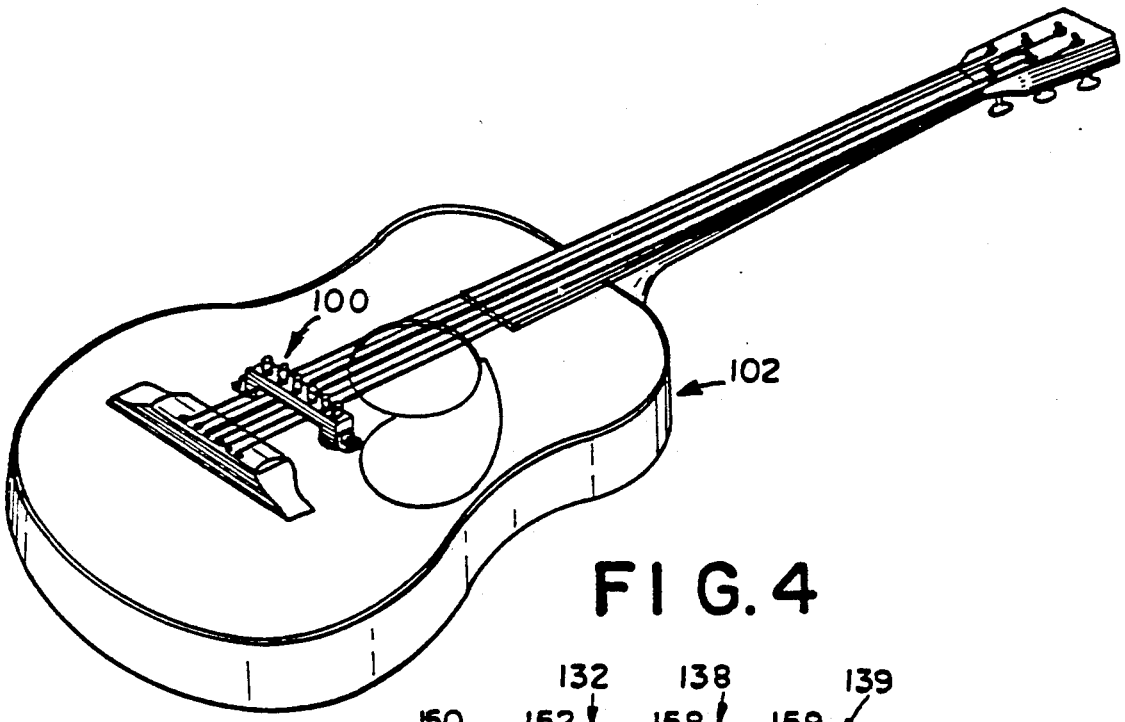
FIG. 4 is a perspective view of a guitar that has a power operated string vibrating device associated therewith in accordance with a second preferred embodiment of the invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the power operated string vibrating device and designated parts thereof. The terminology includes the words above specifically mentioned, derivatives thereof and words of similar import.

Referring to the drawings in detail, wherein like numerals indicate like elements throughout, there is shown in FIGS. 1 through 3 a first preferred embodiment of a power operated string vibrating device in accordance with the present invention.

FIG. 1 illustrates a power operated string vibrating device, generally designated 10, for selectively vibrating a string of a stringed musical instrument having at least one string. The preferred embodiments disclosed herein are preferably used in conjunction with a conventional or electric guitar. However, it is clearly understood that the power operated string vibrating device of the present invention is equally applicable to any type of stringed musical instrument, including banjos, fiddles, cellos, violins or the like.

It is understood by those skilled in the art that while the following description is directed to an embodiment for selectively vibrating at least one of six strings, it is obvious that the present invention can be adapted to vibrate any number of strings, including a single string, without departing from the spirit and scope of the invention. In addition, it is also apparent to those skilled in the art that while the presently disclosed embodiments are directed to a single string vibrating device for vibrating one or more strings, it is obvious that the present invention can be adapted to vibrate a single string only and that a plurality of such power operated string vibrating devices could be individually associated with one of a plurality of strings on a musical instrument.

Referring now to FIG. 1, a generally block-shaped support member 12 is positioned on a musical instrument (not shown) proximate a plurality of generally parallel longitudinally extending strings 20, 22, 24, 26, 28 and 29. Mounting means are provided on support member 12 for rotatably supporting an endless cable 14 thereon. The mounting means has a first position such that the cable 14 does not contact any of the strings 20, 22, 24, 26, 28 and 29 and a second position wherein cable 14 selectively contacts one or more of the strings 20, 22, 24, 26, 28 and 29.

In the first preferred embodiment, support member 12 is positioned and secured on the musical instrument using a hook and loop material 16. However, it is appreciated by those skilled in the art that other means may be used for securing support member 12 to the musical instrument, such as straps, screws or an adhesive such as epoxy.

In the presently preferred first embodiment, support member 12 is constructed of a lightweight, high strength material, such as steel. However, it is understood by those skilled in the art that support member 12 can be constructed of other materials, such as a polymeric material or aluminum.

For convenience and ease of description only, the remaining components of the power operated string vibrating devices, described hereinafter, are preferably constructed of a high strength, lightweight material, such as steel, except as noted. However, it is understood by those skilled in the art that the various components can be constructed of other materials. For example, the non-load bearing components could be constructed of a polymeric material.

As shown in FIG. 1, a first pulley 40 is rotatably mounted on support member 12 beneath or on a first side of string 20. Preferably, first pulley 40 is rotatably mounted on a shaft commonly designated 41, which is mounted on support member 12 in a cantilever manner, as shown in FIG. 3. First pulley 40 drivingly receives cable 14 for guiding cable 14 along a predetermined path. Further, first pulley 40 is associated with string 20, for vibrating and/or contacting the same.

FIGS. 1 and 2 depict a plurality of additional first pulleys 42, 44, 46, 48 and 49, each being constructed and arranged in a similar manner as first pulley 40 and each being associated with one of the other strings 22, 24, 26, 28 and 29. Hence, the above description of first pulley 40 is equally applicable to additional first pulleys 42, 44, 46, 48 and 49.

As shown in FIGS. 1 and 3, a second pulley 30 drivingly receives cable 14 and is rotatably mounted on a shaft 18, which is mounted on support member 12 above or on a second side of string 20. More particularly, support member 12 includes a bracket 19, which is generally "U" shaped in cross section (see FIG. 3), having shaft 18 mounted thereon. Support member 12 or bracket 19 receives shaft 18 in a cam-like slot, commonly designated 60, for guiding second pulley 30 and shaft 18 between a first position (shown in FIG. 1) and a second position (shown in phantom in FIG. 2), described in detail hereinafter. Specifically, bracket 19 includes a cam-like slot 60 in each of its upwardly depending legs for supporting shaft 18 at both ends thereof. Preferably, a plurality of additional second pulleys 32, 34, 36, 38 and 39 are also similarly positioned on support member 12 and are rotatably supported on a shaft, as described above. That is, second pulleys 32, 34, 36 and 38 are each substantially identical to second pulley 30 and, therefore, the description pertaining to second pulley 30 applies equally here.

As shown in FIGS. 1 and 2, biasing means is provided for biasing each second pulley 30, 32, 34, 36, 38 and 39 towards the first position. In the first preferred embodiment, the biasing means is a spring member, in the present embodiment a coil spring 62 interconnected between each shaft 18 and support member 12 for biasing each second pulley 30, 32, 34, 36, 38 and 39 and shaft 18 towards the first position, as described hereinafter. It is understood by those skilled in the art that second pulleys 30, 32, 34, 36, 38 and 39 and their associated shafts 18 could be biased into the first position by some other means, such as by constructing shaft 18 of a flexible material and positioning shaft 18 on support member 12 in a cantilever fashion or by employing some other type of spring member like a leaf-type spring.

Referring now to FIGS. 1 and 2, an endless cable 14 is drivingly interconnected to each of the first and second pulleys 30, 32, 34, 36, 38, 39, 40, 42, 44, 46, 48 and 49. Endless cable 14 is alternately drivingly engaged between the first and second pulleys associated with string 20 (as shown in FIG. 2) such that when second pulley 30 is in the first position cable 14 does not contact the string 20. However, when second pulley 30 is placed in the second position (shown in phantom in FIG. 2), cable 14 contacts string 20. It is understood by those skilled in the art that each of the second pulleys 32, 34, 36, 38 and 39 similarly have a first and second position for engaging cable 14 with their associated string 22, 24, 26, 28 and 29, respectively. In the first preferred embodiment, cable 14 can be constructed of any high strength flexible material, such as a plurality of intertwined strands of steel, to thereby provide a roughened surface. However, it is understood by those skilled in the art that cable 14 could be constructed of other flexible materials, such as rubber. Furthermore, pulleys 30, 32, 34, 36, 38, 39, 40, 42, 44, 46, 48, 49, 70 and 72 could include drive teeth and cable 14 could include teeth on one side thereof (not shown), for providing a positive drive system without departing from the spirit and scope of the invention.

A drive means is provided on support member 12 for driving cable 14 at a predetermined speed. In the first preferred embodiment, the drive means preferably comprises an electric motor 68 positioned on support member 12. Preferably, a generally L-shaped bracket 71 supports electric motor 68 on support member 12, as shown in FIG. 2. Electric motor 68 includes a drive pulley 70 secured to its output shaft and drivingly engaged to cable 14 for driving cable 14. It is understood by those skilled in the art that electric motor 68 can run either on AC or DC power but preferably is powered by one or more batteries (not shown). Furthermore, it is also understood by those skilled in the art that electric motor 68 is capable of driving cable 14 at selectively, variable speeds.

As shown in FIG. 2, in the first preferred embodiment, a guide pulley 72 is provided on support member 12 for guiding cable 14 between the first and second pulleys and drive pulley 70. It is understood by those skilled in the art that guide pulley 72 may not be necessary or could be arranged on support member 12 in any suitable fashion without departing from the spirit and scope of the invention. For instance, guide pulley 72 becomes unnecessary if electric motor 68 is positioned at the mounting position of guide pulley 72. It is further obvious to those skilled in the art that guide pulley 72 could be adapted to maintain cable 14 tense. For instance, guide pulley 72 could be positioned within a slot and include a spring for biasing the pulley in a direction to tension the cable 14, as is known to those skilled in the art.

As shown in FIGS. 2 and 3, actuator means is provided on support member 12 for selectively moving second pulley 30 to the second position. In the first preferred embodiment, the actuator means is a finger engageable button 50 member having an associated linking member secured to shaft 18 and slidably positioned in a slot 79 on the upper surface of support member 12 for selectively moving second pulley 30 between the first and second positions. More particularly, by depressing finger engageable button 50 in the direction of arrow 65 (see FIG. 3), the second pulley 30 and shaft 18 move along cam-like slot 60 from the first position to the second position against the biasing force of spring 62. Moreover, upon releasing finger engageable button 50, the biasing force of spring 62 moves second pulley 30 and shaft 18 in the direction of arrow 63 from the second position to the first position. Preferably, finger engageable button 50 is manually depressed by a finger 80 of the user.

Similarly, as is understood by those skilled in the art, each of the additional second pulleys 32, 34, 36, 38 and 39 include a finger engageable button 52, 54, 56, 58 and 59, respectively, for actuating the respective second pulley between the first position and the second position.

To operate the first preferred embodiment, power operated string vibrating device 10 is positioned on a stringed musical instrument proximate the strings 20, 22, 24, 26, 28 and 29. Electric motor 68 is actuated in any conventional manner to thereby drive cable 14 about each of the pulleys at a generally continuous predetermined speed. The operator can then selectively depress any or all of the finger engageable buttons 50, 52, 54, 56, 58 and 59 for selectively vibrating any or all of strings 20, 22, 24, 26, 28 and 29, respectively. More particularly, depressing finger button 50 moves second pulley 30 and shaft 18 along cam-like slot 60 from the first position to the second position against the biasing force of spring 62 so that cable 14 engages string 20 which thereby vibrates the string and produces sound. Upon releasing finger engageable button 50, the biasing force of spring 62 moves second pulley 30 and shaft 18 from the second position to the first position such that cable 14 no longer contacts string 20. Finger-engageable buttons 52, 54, 56, 58 and 59 are each operated in a similar manner.

A second preferred embodiment of the power operated string vibrating device for selectively vibrating a string of a stringed musical instrument is shown in FIGS. 4 through 7. The power operated string vibrating device, generally designated 100, in accordance with the second preferred embodiment, is perspectively illustrated in FIG. 4 mounted on a conventional acoustic guitar 102.

Figure 5:
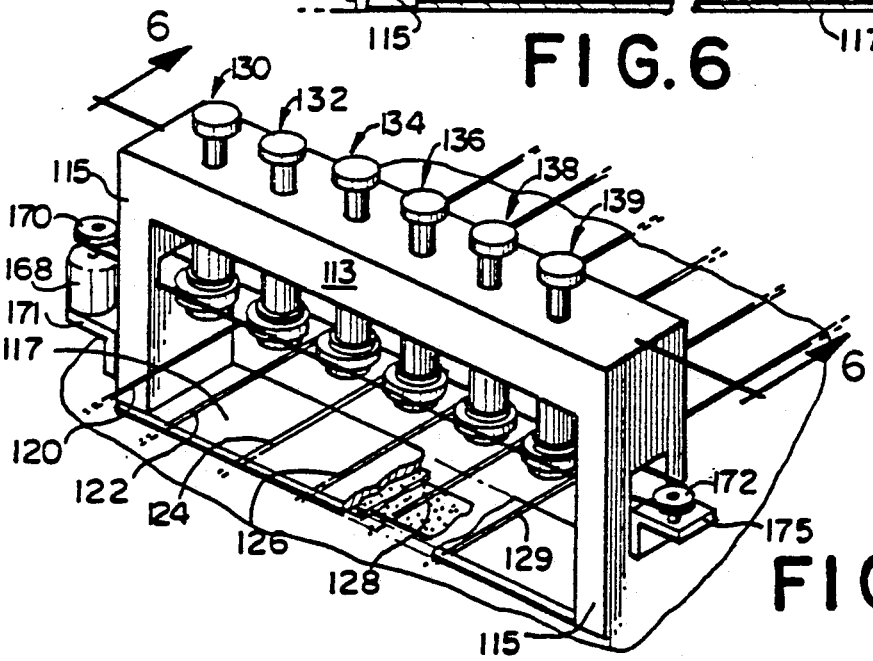
FIG. 5 is an enlarged perspective view, in partial cross section, of the power operated string vibrating device shown in FIG. 4.

Referring now to FIG. 5, string vibrating device 100 includes a generally U-shaped support member 112 positioned on the guitar 102 proximate generally parallel longitudinally extending strings 120, 122, 124, 126, 128 and 129. The support member 112 includes a bridge 113 positioned transverse to and above the strings 120, 122, 124, 126, 128 and 129 for reciprocally and rotatably mounting at least one plunger thereon, as described hereinafter. A pair of generally parallel side legs 115 extend transverse to and are integral with bridge member 113 for supporting bridge member 113 above the strings 120, 122, 124, 126, 128 and 129.

In the second preferred embodiment, support member 113 is secured to the stringed musical instrument 102 by a suitable hook and loop material 116. More particularly, support member 112 preferably includes a base 117 extending parallel to bridge 113 and interconnected between side legs 115. Hook and loop material 116 is preferably secured to the bottom surface of base 117 and to the musical instrument 102, as shown in FIG. 5. However, it is apparent to those skilled in the art that support member 113 can be secured to musical instrument 102 through other means. For instance, such means could include screws (not shown) depending upwardly from musical instrument 102 into parallel legs 115. Moreover, in some circumstances, it may be desirable to secure support member 113 to musical instrument 102 with an adhesive such as epoxy (not shown).

Figure 6:
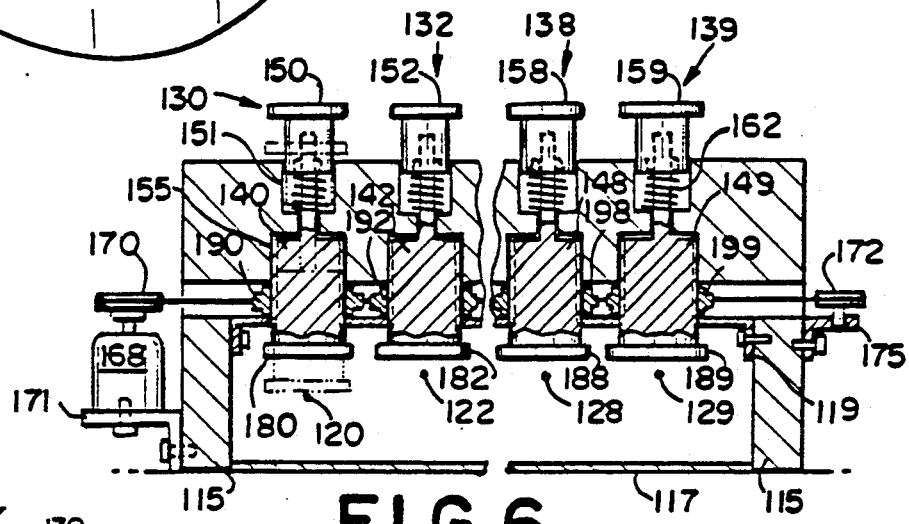
FIG. 6 is an enlarged partial, sectional view of the power operated string vibrating device of FIG. 5 taken along line 6—6 of FIG. 5.

As shown in FIG. 6, a plunger, generally designated 130, is reciprocally and rotatably mounted on support member 112. Plunger 130 is associated with string 120 and includes a generally cylindrically shaped engagement portion 140 for selectively contacting string 120. More particularly, engagement portion 140 is slidably positioned within a suitably sized complementary opening 155 in bridge member 113, for allowing engagement portion 140 to reciprocate therein. Plunger 130 is reciprocally movable between a first position (see FIG. 6) in which engagement portion 140 does not engage string 120 and a second position (shown in phantom in FIG. 6) in which engagement portion 140 engages string 120.

Plunger 130 preferably includes a pulley 190 for drivingly receiving a cable 114, as described hereinafter. Pulley 190 is rotatably fixed to engagement portion 140 and is mounted to move axially with respect thereto. Preferably, pulley 190 and engagement portion 140 each include a set of complementary, generally vertically extending splines 191, as is known to those skilled in the art, for allowing engagement portion 140 to move axially with respect to pulley 150 while being rotatably fixed thereto. Preferably, pulley 190 is positioned between bridge member 113 and a bracket 119, for axially fixing pulley 190 with respect to support member 112.

Referring now to FIGS. 5 and 6, engagement portion 140 includes a generally circular horizontal lower surface 180 for contacting and vibrating string 120. In the second preferred embodiment, horizontal surface 180 is generally roughened such that it has a surface texture similar to that of very fine sand paper. However, it is appreciated by those skilled in the art that horizontal surface 180 can be textured in any suitable manner for vibrating string 120. For instance, horizontal surface 180 can be textured with a plurality of very fine grooves or knurled (not shown).

As shown in FIG. 6, plunger 130 includes a finger engageable button 150 slidably positioned on support member 112 preferably within a suitably sized complementary socket 151. Finger engageable button 150 is fixed to engagement portion 140 to move axially therewith and is rotatably mounted on engagement portion 140 to allow engagement portion 140 to rotate with respect thereto. In the second preferred embodiment, finger engageable button 150 preferably includes a snap ring (not shown) loosely positioned within a generally circumferential groove (not shown) on engagement portion 140 for allowing engagement portion 140 to rotate with respect to finger engageable button 150, but at the same time axially securing finger engageable button 150 and engagement portion 140 together. However, it is apparent to those skilled in the art that other means, such as a thrust and/or roller bearing, could be used for allowing the engagement portion 140 to rotate with respect to the finger button 150 while allowing finger engageable button 150 to be fixed axially to engagement portion 140.

The above description pertaining to plunger 130 is equally applicable to each plunger 132, 134, 136, 138 and 139. That is, each plunger assembly is generally identical to the other plunger assemblies.

Referring now to FIG. 6, biasing means is shown for biasing plunger 130 towards the first position. In the presently preferred embodiment, biasing means is a coil spring, commonly designated 162, interconnected between support member 112 and finger engageable button 150 within socket 151. It is understood by those skilled in the art that other means may be used for biasing plunger 130 towards the first position. For example, an annular sponge-like member could be positioned between support member 112 and finger button 150 for accomplishing the same purpose.

As shown in FIGS. 5 and 6, a drive means is positioned on support member 113 for rotatably driving the engagement portion of each plunger 130, 132, 134, 136, 138 and 139. More particularly, an endless cable 114 is drivingly engaged with each plunger for rotating the engagement portions 140, 142, 144, 146, 148 and 149. Endless cable 114 is preferably constructed of rubber, but as is understood by those skilled in the art, cable 114 can be constructed of other materials, such as "NYLON".

In the presently preferred embodiment, the drive means comprises an electric motor 168 similar to that described in connection with the first preferred embodiment. The electric motor includes a drive pulley 170 secured to its output shaft for drivingly receiving cable 114. Preferably, a generally L-shaped bracket 171 supports electric motor 168 on support member 112, as shown in FIG. 6. Specifically, endless cable 114 is drivingly engaged with each pulley 190, 192, 194, 196, 198 and 199, drive pulley 170 and a guide pulley 172 for rotating the engagement portion of each plunger. Preferably, guide pulley 172 is mounted on a generally L-shaped bracket 175, as shown in FIG. 5. It is understood by those skilled in the art that the drive means can drive cable 114 at selectively variable speeds. It is also understood by those skilled in the art that other means could be used to drivingly interconnect the engagement positions. For instance, pulleys 170, 190, 192, 194, 196, 198 and 199 could be interconnected spur gears or independent spur gears driven by a cable having teeth on one side thereof.

To operate the second preferred embodiment, power operated string vibrating device 100 is positioned on stringed musical instrument 102 proximate the strings 120, 122, 124, 126, 128 and 129. Electric motor 168 is then actuated by any conventional means to thereby drive endless cable 114 about each of the pulleys 170, 172, 190, 192, 194, 196, 198 and 199. Each of the plungers 130, 132, 134, 136, 138 and 139 is biased into the first position by springs 162 such that each engagement portion is not in contact with its associated string. By depressing one or more of the finger buttons 150, 152, 154, 156, 158 and 159, the associated plunger is placed into the second position, thereby causing the horizontal surface of rotating engagement portion of the plunger to engage its associated string, resulting in vibration of the associated string and production of sound. More particularly, depressing finger button 150 moves engagement portion 140 and surface 180 along opening 155 from the first position to the second position against the biasing force of spring 162 so that horizontal surface 180 engages string 120 which thereby vibrates and produces sound. Upon releasing the finger engageable button 150, the biasing force of spring 162 moves engagement portion 140 and horizontal surface 180 from the second position to the first position such that horizontal surface 180 no longer contacts string 120. Finger engageable buttons 152, 154, 156, 158 and 159 are each operated in a similar manner.

From the foregoing description, it can be seen that the present invention comprises a power operated string vibrating device. It is recognized by those skilled in the art that changes may be made to the embodiments described above without departing from the broad inventive concepts thereof. It is understood, therefore, that this invention is not limited to the particular embodiments disclosed, but it is intended to cover all modifications which are within the spirit and scope of the invention as defined by the appended claims.

I claim:

1. A power operated string vibrating device for selectively vibrating a string of a stringed musical instrument having at least one string, said string vibrating device comprising:

a support member positioned on said musical instrument proximate said string;

a first pulley rotatably mounted on said support member on a first side of said string for receiving a cable;

a second pulley for receiving a cable rotatably mounted on a shaft which is mounted on said support member on a second side of said string, said support member receiving said shaft in a cam-like slot for guiding said second pulley and shaft between a first position and a second position;

a spring interconnected between said shaft and said support member for biasing said second pulley and shaft towards said first position;

an endless cable drivingly interconnected to said pulleys, said cable being alternately drivingly engaged between said first and second pulleys such that when said second pulley is in said first position, said cable does not contact the string and, when said second pulley is in said second position, said cable contacts the string;

an electric motor positioned on said support member and having a drive pulley drivingly engaged to said cable for driving said cable, said electric motor driving said cable at selectively variable speeds;

at least one guide pulley for guiding said cable between said first and second pulleys and said drive pulley; and a finger engageable button secured to said shaft and slidably positioned on said support member for selectively moving said second pulley between said first and second positions, whereby when said second pulley is in said first position, said string does not produce sound and when said second pulley is in said second position, said string is vibrated by said cable and thereby produces sound.

2. A power operated string vibrating device for selectively vibrating a string of a stringed musical instrument having a plurality of strings mounted on a face of said musical instrument, said string vibrating device comprising:

a support member positioned on said musical instrument proximate said strings;

a corresponding plurality of first pulleys rotatably mounted on said support member on a first side of each said strings between said plurality of strings and said face of said musical instrument each for receiving a cable, each of the first pulleys having one of said plurality of strings associated therewith;

a corresponding plurality of second pulleys rotatably mounted on said support member on a second side of each said strings for receiving the cable, the plurality of second pulleys each being movable between a first position and a second position;

biasing means for biasing each of said second pulleys towards said first position;

an endless cable drivingly interconnecting each of said pulleys such that when the plurality of second pulleys is in said first position, said cable does not contact any of the strings and, when one of said plurality of second pulleys is in said second position said cable contacts the string which corresponds to said one pulley, said cable being interwoven between each said first and second pulleys and said plurality of strings;

drive means on said support member for driving said cable at a predetermined speed; and actuator means on said support member for selectively moving one or more of said plurality of second pulleys to said second position, whereby when said plurality of second pulleys is in said first position, said plurality of strings do not produce sound and when one or more of said plurality of second pulleys is in said second position, corresponding strings are vibrated by said cable and thereby produce sound.

3. The string vibrating device as recited in claim 2 wherein said drive means comprises an electric motor having a drive pulley drivingly engaging said cable.

4. The string vibrating device as recited in claim 2 wherein said predetermined speed is selectively variable.

5. The string vibrating device as recited in claim 2 wherein said cable is alternately drivingly engaged between said first and second pulleys.

6. THe string vibrating device as recited in claim 2 wherein said cable is transversely positioned with respect to each string on said musical instrument.

7. A power operated string vibrating device for selectively vibrating a string of a stringed musical instrument having at least one string, said string vibrating device comprising:

a support member positioned on said musical instrument proximate said string;

a first pulley rotatably mounted on said support member on a first side of said string for receiving a cable;

a second pulley for receiving a cable, said second pulley being rotatably mounted on a shaft mounted on said support member, said shaft and second pulley being positioned on a second side of said string, said support member receiving said shaft in a cam-like slot for guiding said second pulley and shaft between a first position and a second position;

biasing means for biasing said second pulley toward said first position;

an endless cable drivingly interconnecting said pulley such that when the second pulley is in said first position, said cable does not contact the string and, when the second pulley is in said second position, said cable contacts the string;

drive means on said support member for driving said cable at a predetermined speed; and actuator means on said support member for selectively moving the second pulley to said second position, whereby when said second pulley is in said first position, said string does not produce sound and when the second pulley is in said second position, said string is vibrated by said cable and thereby produces sound.

8. The string vibrating device as recited in claim 7 wherein said biasing means is a spring interconnected between said shaft and said support member.

9. The string vibrating device as recited in claim 7 wherein said actuator means further includes a finger engageable button secured to said shaft, whereby depressing said finger engageable button moves said second pulley and shaft along said cam-like slot from said first position to said second position against said biasing means and upon releasing said finger engageable button said biasing means moves said second pulley and shaft from said second position to said first position.

* * * * *